US006786430B2

(12) United States Patent
Hayashi

(10) Patent No.: US 6,786,430 B2
(45) Date of Patent: Sep. 7, 2004

(54) LIQUID ATOMIZING NOZZLE

(75) Inventor: Shigeru Hayashi, Chofu (JP)

(73) Assignee: National Aerospace Laboratory of Japan, Tokyo (JP)

( * ) Notice: Subject to any disclaimer, the term of this patent is extended or adjusted under 35 U.S.C. 154(b) by 0 days.

(21) Appl. No.: 10/345,956

(22) Filed: Jan. 17, 2003

(65) Prior Publication Data

US 2003/0141383 A1 Jul. 31, 2003

(30) Foreign Application Priority Data

Jan. 21, 2002 (JP) ..... 2002-011546

(51) Int. Cl.[7] ..... B05B 7/10; F02C 1/00; F02G 3/00

(52) U.S. Cl. ..... 239/406; 239/403; 239/405; 60/748; 60/743

(58) Field of Search ..... 239/406, 403, 239/405, 399, 422, 423, 424.5, 428, 429, 430, 433, 434.5; 60/748, 743

(56) References Cited

U.S. PATENT DOCUMENTS

| | | | | |
|---|---|---|---|---|
| 1,462,395 A | | 7/1923 | Thompson | |
| 2,539,315 A | | 1/1951 | Murphy | |
| 3,844,484 A | | 10/1974 | Masai | |
| 3,980,233 A | * | 9/1976 | Simmons et al. | 239/400 |
| 4,170,108 A | | 10/1979 | Mobsby | |
| 5,102,054 A | * | 4/1992 | Halvorsen | 239/533.2 |

FOREIGN PATENT DOCUMENTS

| | | |
|---|---|---|
| GB | 1 134 390 | 11/1968 |
| JP | 2001-280155 | 10/2001 |

* cited by examiner

*Primary Examiner*—Michael Mar
*Assistant Examiner*—Darren Gorman
(74) *Attorney, Agent, or Firm*—Westerman, Hattori, Daniels & Adrian, LLP

(57) ABSTRACT

This invention provides a liquid atomizing nozzle which utilizes a swirling flow of gas to form a liquid film in as uniform thickness as possible in a circumferential direction, and in which blockages are difficult to develop, and which can facilitate atomization by further reducing the size of the droplets which disperse from the front end. A liquid injected into an annular space 7 through liquid passages 14 formed in an outer cylinder 2 in an incline to the radial direction, flows within the annular space 7 having a component swirling in the circumferential direction. Air which flows into the annular space 7 through air passages 10 formed inclined in the same direction as the liquid passages in the outer cylinder 2, develops a swirling flow Ac within the annular space 7, acts upon the injected liquid to spread it onto an inner wall 5 of the outer cylinder 2, and further improving the uniformity of the thickness of the liquid film in a circumferential direction. When the liquid film disperses from the front end edge 16 of the outer cylinder 2, atomization is facilitated and the size of the droplets may be reduced further.

7 Claims, 4 Drawing Sheets

(a)

(b)

(c)

(a)

(b)

(c)

(a)

(b)

(c)

(d)

Prior Art

LIQUID ATOMIZING NOZZLE

BACKGROUND OF THE INVENTION

1. Field of the Invention

The present invention relates to a liquid atomizing nozzle, and more particularly to a liquid fuel atomizing nozzle to be used in a combustion chamber of a jet engine, gas turbine or the like, by an air stream of air or the like.

2. Description of the Related Art

As one means for atomizing liquids, there are air-blast liquid fuel atomizing nozzles which atomize liquid fuel by means of an air blast, which have come to be used in recent jet engines and liquid fueled gas turbines. Air-blast liquid fuel atomizing nozzles are a form of nozzle wherein liquid fuel is atomized by means of an air blast which flows into a combustion chamber. The liquid fuel is supplied in the form of a liquid film, and as a result of this thin liquid film contacting with an air stream having a speed of several tens of meters per second, is atomized from the front end edge of the nozzle into free space. Atomization is facilitated by supplying liquid fuel in a liquid film.

FIG. 4 is a diagram which shows one example of the structure of a typical air-blast liquid fuel atomizing nozzle of the liquid film method. FIG. 4(*a*) is a longitudinal sectional view thereof, FIG. 4(*b*) is a B4—B4 sectional view of (*a*), FIG. 4(*c*) is a C4—C4 sectional view of (*a*), and FIG. 4(*d*) is a D4—D4 sectional view of (*a*). The air-blast liquid fuel atomizing nozzle 30 (hereafter abbreviated as "atomizing nozzle") shown in FIG. 4 comprises a tapered outer cylinder 32 which is formed with a progressively thin-walled front end section, and an inner cylinder 33 which is arranged within the outer cylinder 32 in a condition extending along the same axis. An annular space 37 which is open towards the front end side is formed between the inner wall surface 35 of the outer cylinder 32 and the outer wall surface 36 of the inner cylinder 33. The annular space 37 is formed in a conical shape of a reducing diameter towards the front end side. The outer cylinder 32 and the inner cylinder 33 connect at a cylindrical nozzle base 34 in the back end.

The back end section of nozzle base 34 is connected to a pipe 40 to receive a supply of a liquid fuel LF to be atomized, and the liquid fuel LF supplied though the pipe 40 passes through a passage 41 formed within the nozzle base 34 and flows into an annular liquid reservoir 42 formed within the same nozzle base 34. The liquid reservoir 42 and the annular space 37, as is shown in FIG. 4(*d*) in particular, connect through a plurality of spiral passages 43 which are formed in parallel to each other. The liquid fuel LF which has flowed into the annular space 37 from the spiral passages 43, flows and forms a liquid film FF over the inner wall surface 35 of the outer cylinder 32, and is atomized from a front end edge 44 arising from the thin wall of the outer cylinder 32 and flows out into free space.

The liquid fuel LF is given a rotating motion by being passed through the spiral passages 43, and this rotation produces an action of inducing a spreading and moreover stabilization and the like in the liquid film FF on the inner wall surface 35 of the outer cylinder 32. The part of the atomizing nozzle 30 that forms the liquid film FF is called a prefilmer (liquid film forming section) 45. Along an outer wall surface (the outer wall surface of the outer cylinder 32) 46 and an inner wall surface (the inner wall surface of the inner cylinder 33) 47 of the prefilmer 45, air is flowing into a combustion chamber (the air streams Ao, Ai). Most commonly, a rotating motion is given to the air streams Ao, Ai which flow through the passages within and without the prefilmer 45 by swirl vanes 48,49 in order to facilitate mixing of air and fuel particles that have been atomized and in order to stabilize the flame within the combustion chamber. The liquid film FF is atomized largely through air encountering these, namely an air stream Ai flowing along the inner wall surface 47, but the rotation of the air stream Ai on this inner side is also effective in stabilizing the liquid film FF on the prefilmer 45. The air stream Ao which flows along the outer wall surface 46 of the prefilmer 45 also produces an action which prevents liquid from running back from the front end edge 44 to the outer wall surface 46, and prevents bulking of the liquid fuel particles which are atomized from the front end edge 44.

With air-blast liquid fuel atomizing nozzles, it is important to make the properties of the spray resulting from the fuel particles which have been atomized symmetrically around the axis of the nozzle. If there are deviations in the fuel concentration in the circumferential direction around the axis of the nozzle, due to differences in the ratio of fuel and air (air-fuel ratio) according to the position around the axis of the nozzle, the flame stability is impaired, producing deviations in the temperature distribution within the combustion chamber, and as a result, high temperature combustion or locally incomplete combustion occurs, giving rise to problems of increased generation of harmful components or incompletely combusted components.

In the atomizing nozzle 30 shown in FIG. 4, due to the spiral passages 43 or the liquid passages corresponding thereto being set located apart in the circumferential direction, there is a tendency for the thickness of the liquid film FF to become thick in positions around the circumference which correspond to the spiral passages 43 or the liquid passages, even on the prefilmer 45. In cases where the number of the spiral passages 43 is low or the axial length of the prefilmer 45 is short, this tendency is particularly pronounced. Easing this problem by making the annular space 37 an extremely narrow annulus could be considered, but in cases which adopt this kind of measure, the liquid fuel cannot be given rotation. Moreover, when attempting to resolve this problem by making the cross-sectional area of the spiral passages 43 smaller and in exchange increasing the number of the spiral passages 43, another problem occurs of passage blockages developing easily as a result of solid deposits in the liquid fuel.

Furthermore, in times of low fuel flow rates, there is a tendency for the flow rate of fuel passing through the spiral passages 43 in the bottom side to become larger than in the upper side due to pressure differences in the top and bottom of the liquid reservoir 42 resulting from gravitational force, and due to this a problem occurs in which the fuel discharge volume of the atomizing nozzle 30 deviates in the circumferential direction. There are also cases where these kind of deviations can be eased by reducing the cross-sectional area of the spiral passages 43 and by applying adequately high pressure to the fuel in liquid reservoir 42 so that pressure differences which occur through gravitational force can be ignored, but in many cases elevation of the fuel pressure is restrained by problems such the above-mentioned blockages through solid deposits or fuel flow rate turndown ratios (the maximum fuel flow rate of an engine divided by the minimum fuel flow rate).

The strongest controlling factor on the size of the droplets formed by means of atomization is the thickness of the liquid film, and in the development of air-blast liquid atomizing nozzles, efforts have been focused on how to form a thin liquid film which is furthermore uniform around the circumference. If the liquid film becomes thick, even locally, the larger droplets generated there become, and in a case of liquid fuel may be tied to outbreaks of smoke-generation or incomplete combustion. In order to avoid these drawbacks in combustion which are ascribable to deviations in fuel concentration, it is essential to disperse the liquid fuel as uniformly as possible in the circumferential direction around the nozzle axis.

Consequently, in air-blast liquid atomizing nozzles, dispersing the liquid as much as possible uniformly in the circumferential direction of the nozzle, namely, forming a liquid film which is as much as possible uniformly thin in the circumferential direction of the nozzle axis, and facilitating further the atomization of the liquid is a problem that has to be resolved. In the case of a liquid fuel, if the air which flows into the combustor can be utilized to make the liquid film uniform, it can be expected to be useful in simplifying the structure.

SUMMARY OF THE INVENTION

An object of this invention is to provide a novel liquid atomizing nozzle which further facilitates the atomization of liquid, and dramatically improves uniformity in the circumferential direction and furthermore reduces the thickness of a liquid film, in order to solve the above problems in an air-blast liquid atomizing nozzle which disperses a liquid film with an air blast.

In order to solve the above problems, a liquid atomizing nozzle comprises an outer member, and an inner member which is arranged within the outer member and forms an annular space which is open towards a front end side with the outer member, so that a liquid that has been injected into the annular space is atomized from the front end of the outer member, and in this liquid atomizing nozzle the outer member is provided with liquid passages inclined to the radial direction and for injecting the liquid into the annular space, and at least one of the outer member and the inner member is provided with gas passages that are opening to the annular space and are inclined to the radial direction in order to swirl a gas in the same direction as the flow direction of the liquid that has been injected into the annular space.

According to this liquid atomizing nozzle, the liquid which is injected into the annular space through the liquid passages formed in the outer member flows within the annular space interior having a component swirling in the circumferential direction because the liquid passages are formed inclining to the radial direction. Because the gas passages in at least one of the above outer and inner members which are formed in a condition opening into the annular space are also formed inclining to the radial direction, the gas which flows into the annular space generates a swirling flow within the annular space. However, because the direction of this swirling flow is the same with the direction of the liquid in the annular space which has been injected from the liquid passages, through the swirling flow of the gas, an injected liquid flow which flows within the annular space is efficiently spread over the surface of the inner wall of the outer member as a liquid film. In other words, the strong swirling flow of the gas which flows into the annular space is utilized, so that even in a case where there are deviations in the outflow of liquid to the annular space interior, through the swirling flow of the gas, thick sections of the liquid film flow and spread out circumferentially to thin sections of the liquid film, and the thickness of the liquid film is made uniform in the circumferential direction.

Furthermore, even in a case where the flow rate of the liquid is low and there are large deviations in the circumferential direction in the outflow of liquid from the liquid passages which connect to the liquid reservoir, the liquid is spread in the circumferential direction by the swirling flow of the gas within the annular space. Accordingly, the liquid film which has been extended is atomized in small droplets from the front end edge of the outer member, and atomization is promoted. Additionally, because this liquid atomizing nozzle does not require the cross sections of the discharge passages of the liquid to be reduced, it may be applied to liquids in which solid deposits develop easily through rises in temperature, as can be seen in fuels such as heavy oils and the like. The gas passages may be formed in either or both the inner and outer members, but from the standpoint of swirling flow, which becomes stronger as the swirling radius becomes smaller, and the size-reduction and the like of liquid atomizing nozzles, forming the gas passages in the outer member is desirable.

In this liquid atomizing nozzle, the above gas passages can be made to be open in a condition tangential to the circumference of the inner wall surface of the above outer member. By constructing the gas passages in this way, the gas which has passed through the gas passages inflows in a tangential direction to the annular space and a strong swirling flow can be efficiently formed. In this case, the incline to the radial direction of the gas passages becomes a right angle. As a configuration to make the gas passages be open in a condition tangential to the circumference of the annular space, the wall surface which forms the gas passages, for example a part of the wall surface which has a rectangular cross section, can be placed within a plane tangential to the inner wall of the outer member.

Furthermore, in this liquid atomizing nozzle, the above liquid passages can be made to be open in a condition tangential to the circumference of the inner wall surface of the above outer member. By constructing the liquid passages in this way, the liquid which has passed through the liquid passages inflows in a tangential direction to the inner wall surface of the outer member forming the annular space, and the uniformity of the thickness of the liquid film which is formed on the inner wall surface can be improved. As a configuration to make the liquid passages be open in a condition tangential to the circumference of the annular space, the wall surface which forms the liquid passages, for example a part of the wall surface which has a rectangular cross section, can be placed within a plane tangential to the inner wall of the outer member.

In this liquid atomizing nozzle, it is desirable that the above liquid passages and the above gas passages are made to be open into the above annular space alternately in the circumferential direction. By forming the liquid passages and the gas passages in this way, any liquid whatsoever which has passed through the liquid passages and been injected into the annular space will be spread more uniformly on the inner wall of the outer member through the swirling flow of the gas flowing into the annular space through the gas passages, and the thickness of the liquid film can be made circumferentially uniform.

In this liquid atomizing nozzle, as viewed in the direction of the axis of the above liquid atomizing nozzle, the above gas passages can be made to be open within the above annular space in essentially the same position as the above liquid passages are open in the annular space or in a position further to the rear side than this. By injecting the gas before the liquid and forming a swirling flow, and injecting the liquid into this swirling flow, or injecting the gas and the liquid in essentially the same position as viewed in the direction of the nozzle axis of the liquid atomizing nozzle, the extension of the liquid over the surface of the inner wall of the outer member can be made all the more uniform.

In this liquid atomizing nozzle, the outer member may be a tapered cylinder in which the front end is thin walled, and an inner cylinder which is disposed on the same axis as the above outer cylinder and is connected at the rear side through the inside of which air stream flow which atomizes the above liquid at the front end of the above annular space. The liquid injected in the annular space is atomized from the front end of the tapered outer cylinder by the air stream flowing through the interior of the inner cylinder and disperses.

In this liquid atomizing nozzle, swirlers may be provided in at least one of the areas consisting of the interior of the above inner cylinder or the exterior of the above outer cylinder for giving swirling movement to the gas stream flowing along the above-mentioned interior or the above-mentioned exterior. As a result of providing swirlers, the flow of the gas which has been given swirling movement flows to the outer side or inner side of the prefilmer that forms a liquid film. The rotating gas which flows on the inner side of the prefilmer facilitates further the atomizing of the droplets when the liquid film of the liquid membrane is disintegrated at the front end edge of the outer cylinder, and the rotating gas flow which flows on the outer side of the prefilmer may preventing liquid particles that are atomized from the front end edge from getting large in size.

DESCRIPTION OF THE PREFERRED EMBODIMENTS

Figure 1:
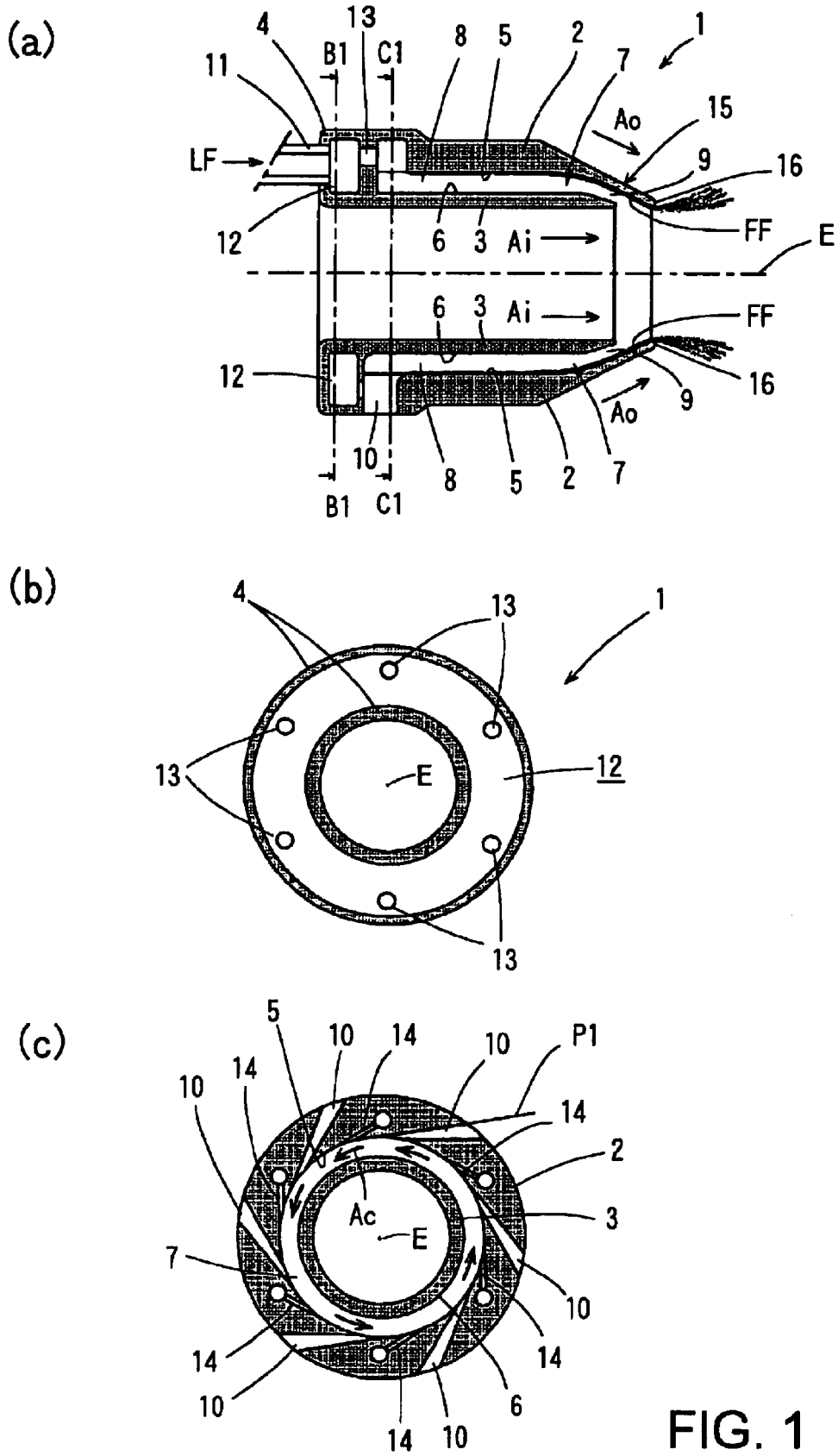
FIG. 1 is a cross-sectional view which shows an outline of one embodiment of a liquid atomizing nozzle of this invention.

Embodiments of a liquid atomizing nozzle of the present invention will be described with reference to the diagrams. FIG. 1 is a diagram which shows one embodiment of a liquid atomizing nozzle according to this invention, and FIG. 1(*a*) is a longitudinal cross-sectional view thereof. FIG. 1(*b*) is a B1—B1 cross-sectional view of (*a*), and FIG. 1(*c*) is a C1—C1 cross-sectional view of (*a*). In the liquid atomizing nozzle 1 shown in FIG. 1, an outer cylinder 2 as an outer member formed with the front end that is tapered and furthermore progressively thin-walled, and an inner cylinder 3 as an inner member, are disposed along the same axis, and these are connected to a nozzle base 4 on the back end side. Between the inner wall surface 5 of the outer cylinder 2 and the outer wall surface 6 of the inner cylinder 3, an annular space 7 is formed. The annular space 7 is formed with a cylindrical section 8 positioned at the back end side, and a conical section 9 which connects smoothly with the cylindrical section 8 and inclines to the inside and in addition is open towards the front end. The sections of the front end of the outer cylinder 2 and the inner cylinder 3 which are thin-walled, constitute a prefilmer 15 which is the section that forms a liquid film. In the liquid atomizing nozzle 1 a liquid may be a liquid fuel, and a gas may be air.

In the outer cylinder 2, air passages 10 are formed as a plurality of gas passages which lead to the annular space 7, passing through the wall section thereof. Each of the air passages 10 is a passage which represents a rectangular cross section produced on a plane, and is formed in an incline to the radial direction with the nozzle axis line E as the center, while the cross-sectional area of the passages is a progressively reduced until opening to the annular space 7. By passing through the air passages 10 in which the cross-sectional passage area becomes narrower, the air flows into the annular space 7 in a condition of accelerated flow rate as a result of a nozzle action, and due to the incline of each of the air passages 10, in the annular space 7, a swirling flow Ac occurs as is shown by the arrow in FIG. 1(*c*). The swirling flow Ac flows in the annular space 7 from the cylindrical section 8 to the conical section 9 towards the nozzle front end side. Because the conical section 9 is formed with a taper, the flow rate of the swirling flow Ac becomes stronger closer to the nozzle front end side. As a result of the incline angle of the air passages 10 to the radial direction being a right angle, the air passages 10 can be made to be open in a tangential direction with respect to the circumference of the annular space 7. As one example, a part of the passage wall surface that constitutes the air passages 10 can be placed within a plane P1 which is tangential to the inner wall surface 5 of the outer cylinder 2. The air which flows into the annular space 7 through the air passages 10, inflows in a tangential direction to the annular space 7, and a strong swirling flow Ac can be formed efficiently.

At the back end section of the nozzle base 4, a pipe 11 is connected to receive a supply of a liquid fuel LF to be atomized, and the pipe 11 connects to an annular liquid reservoir 12 which is formed inside of the nozzle base 4. In the outer cylinder 2, as is shown in FIG. 1(*b*) in particular, a plurality of passages (in this example, 6 passages) 13 are formed in a condition extending from the liquid reservoir 12 in a direction parallel to the nozzle axis line. Furthermore, at the front end of each of the passages 13, liquid passages 14 of a slit shape which are inclined towards the inside and connect to the annular space 7 are formed. The air passages 10 and the liquid passages 14 are arranged alternately in the circumferential direction in the outer cylinder 2, and moreover are inclined towards the same direction with respect to the radial direction which connects each of the air passages 10 and each of the liquid passages 14, with the nozzle axis line E as the center. The liquid passages 14 also, in the same way as the air passages 10, are open in a tangential direction with respect to the circumference of the annular space 7. As one example, a part of the passage wall surface that forms the liquid passages 14 can be placed within a plane which is tangential to the inner wall surface 5 of the outer cylinder 2. After flowing into the annular liquid reservoir 12, the liquid fuel LF passes through the plurality of the passages 13 and is jetted into the annular space 7 from the slit-shaped liquid passages 14. The liquid fuel LF flows into the interior of the annular space 7 in a tangential direction to the inner wall surface 5 of the outer cylinder 2, and it becomes easy to form a liquid film of uniform thickness on the inner wall surface 5 of the outer cylinder 2. In addition, as is shown in the examples of the diagrams, it is desirable for the liquid passages 14 and the air passages 10 to be opening set apart at equiangular distances in the circumferential direction and furthermore at the same angle of inclinantion to the radial direction, but the placement of the liquid passages 14 and the air passages 10 is not necessarily limited to this.

As already explained, the air which flows through the air passages 10 and into the annular space 7 generates the swirling flow Ac. The liquid fuel LF which is supplied through the pipe 11 passes from the liquid reservoir 12 through the passages 13 and jets into the annular space 7 through the slit-shaped liquid passages 14 connected to each of the passages 13. The liquid passages 14 and the air passages 10 are formed alternately in a circumferential direction in the outer cylinder 2 and furthermore facing the same direction, so that the liquid fuel LF flows into the annular space 7 having some measure of a swirling component, and in addition is spread on the inner wall surface 5 of the outer cylinder 2 by the swirling flow Ac which flows towards the same direction. The spread liquid fuel LF forms a liquid film FF over the inner wall surface 5 of the outer cylinder 2 which forms the annular space 7, and flows towards the front end thereof along on the prefilmer 15. In the opening at the front end side of the prefilmer 15, the liquid fuel LF which forms the liquid film FF contacts the air stream Ai which flows through the inside of the inner cylinder 3, and is atomized and dispersed from a thin-walled front end edge 16 of the inner cylinder 3 into free space by the air stream Ai.

According to this embodiment, the strong swirling of the air stream that flows into the annular space 7 as a swirling flow can be utilized, so that compared to conventional liquid film-methods of air-blast atomizing nozzles, which typically spread a liquid film by the swirling of a liquid such as fuel, an improvement in the uniformity of the liquid film thickness in the circumferential direction can be achieved. In particular, even in cases of deviations in the flow rate of the fuel such as those ascribable to the upper and lower positions of the liquid passages 14, through the circumferential spreading action brought about by the swirling flow Ac in the annular space 7, compared to conventional arts a superior effect is achieved, enabling a liquid film of a more uniform circumferential thickness. Moreover, this liquid film-method of a liquid atomizing fuel nozzle does not require a reduction in the cross-section of the discharge passages of the liquid as a countermeasure to circumferential nonuniformity of the liquid film thickness, so that it can also be applied to heavy oils in which solid deposits develop easily through rises in combustion temperature.

Figure 2:
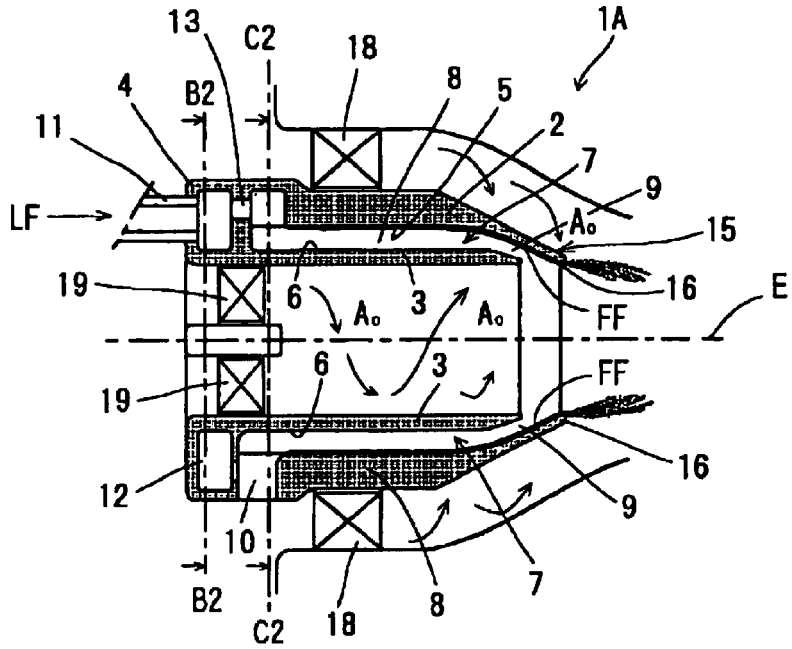
FIG. 2 is a cross-sectional view which shows an outline of a different embodiment of a liquid atomizing nozzle of this invention.
Figure 2:
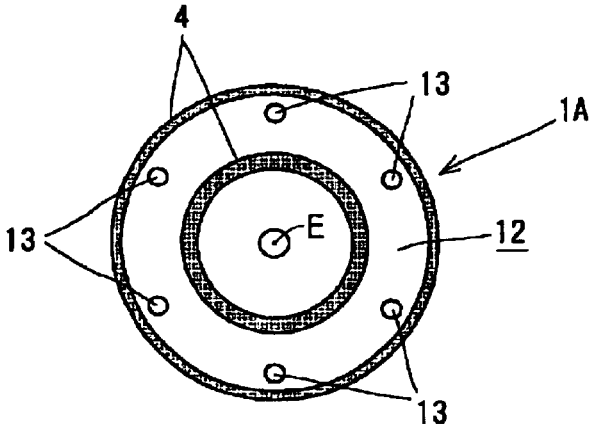
Figure 2:
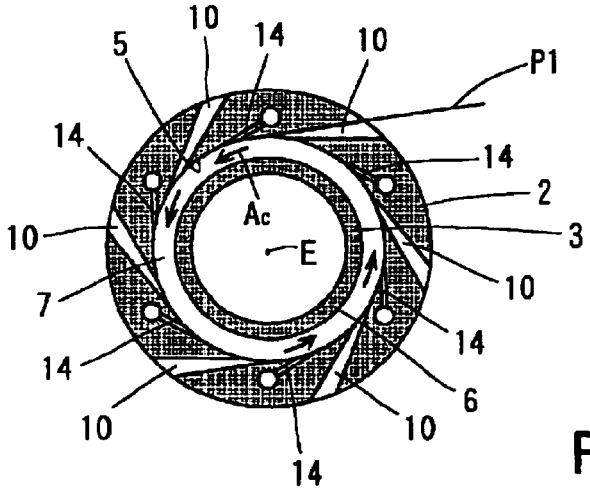

FIG. 2 is a diagram which shows another embodiment of a liquid atomizing nozzle of this invention, and as in FIG. 1, FIG. 2(*a*) is a longitudinal cross-sectional view of the nozzle. FIG. 2(*b*) is a B2—B2 cross-sectional view of (*a*), and FIG. 2(*c*) is a C2—C2 cross-sectional view of (*a*). In the liquid atomizing nozzle 1A shown in FIG. 2, the same symbols will be assigned to sites which perform the same function as the embodiment shown in FIG. 1 and a repeat of a detailed explanation will be omitted. On the liquid atomizing nozzle 1A, to the outer side and inner side of the prefilmer 15, the air streams Ao, Ai, which have been given swirling movement by the axial stream-type air swirlers 18 and 19, are flowing. The liquid film FF is drawn forth into free space from the front end edge 16 of prefilmer 15 by these air streams Ao, Ai, but in so doing, atomization is further promoted by the swirling character of the air streams Ao, Ai. For the air swirlers 18, 19, a different form to the axial flow of this embodiment, for example a centrifugalform, is also acceptable.

Figure 3:
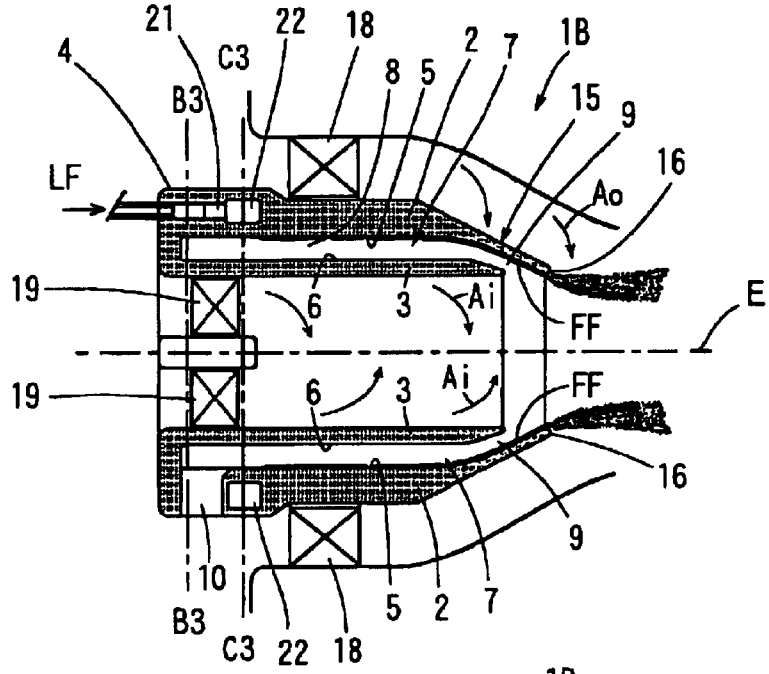
FIG. 3 is across-sectional view which shows an outline of another embodiment of a liquid atomizing nozzle of this invention.
Figure 3:
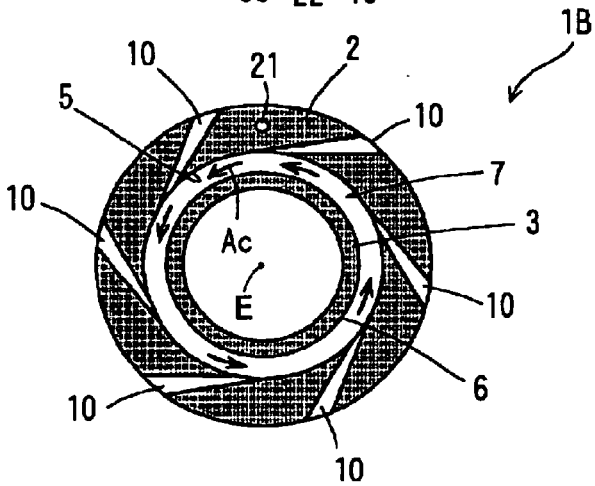
Figure 3:
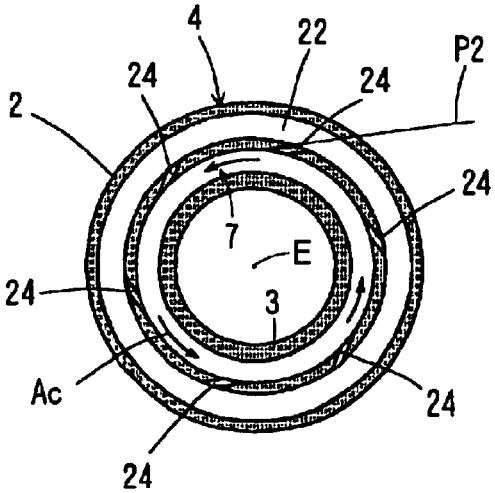
Figure 4:
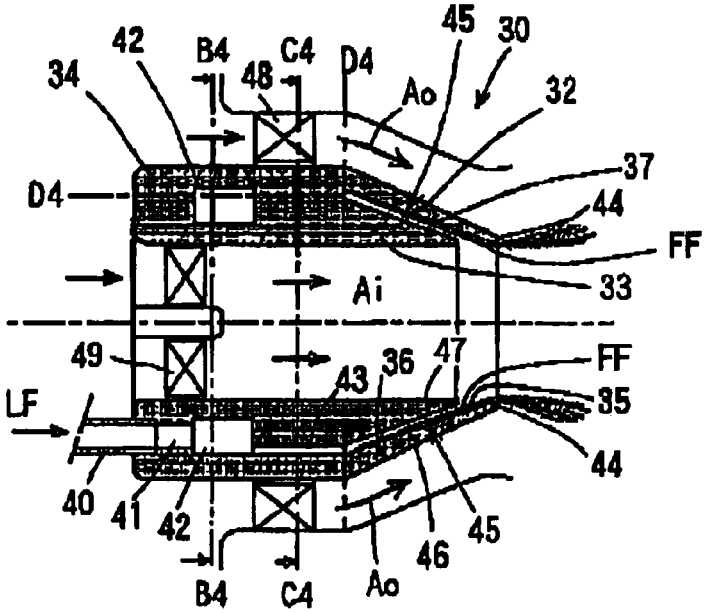
FIG. 4 is a conceptual of a conventional liquid atomizing nozzle.
Figure 4:
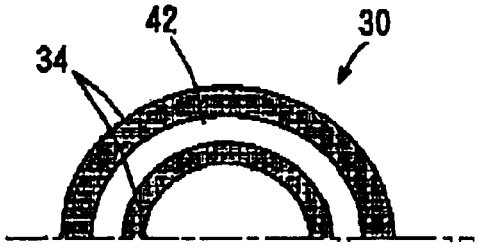
Figure 4:
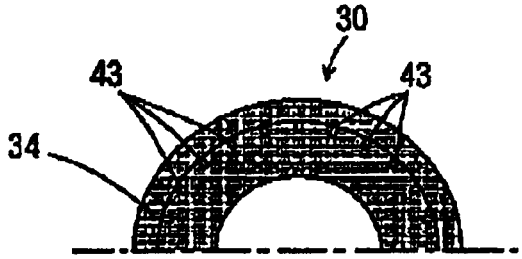
Figure 4:
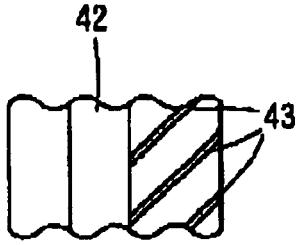

FIG. 3 is still another embodiment of a liquid atomizing nozzle of this invention, and as in FIG. 2, FIG. 3(*a*) is a longitudinal cross-sectional view of the nozzle. FIG. 3(*b*) is a B3—B3 cross-sectional view of (*a*), and FIG. 3(*c*) is a C3—C3 cross-sectional view of (*a*). In the liquid atomizing nozzle 1B shown in FIG. 3, the same symbols will be assigned to sites which perform the same function as the embodiment shown in FIG. 2 and a repeat of a detailed explanation will be omitted. In the liquid atomizing nozzle 1B shown in FIG. 3, air flows into the annular space 7 from the air passages 10 which represent a rectangular cross section as produced on a plane and furthermore which are inclined in the radial direction of the nozzle as in the example shown in FIG. 2. The liquid fuel LF initially passes through a passage 21 in the axial direction and flows into the annular liquid reservoir 22, and from the liquid reservoir 22 passes through liquid passages 24 which are inclined to the direction of the radius with the nozzle axis E as the center, and drains into the annular space 7. The liquid passages 24 have a slit shape with a rectangular cross section, and are open in a tangential direction to the circumference in the annular space 7, as one example, such that a part of this wall surface is within a plane P2 which is tangential to the inner wall surface 5 of the outer cylinder 2. The air passages 10 and the liquid passages 24 are arranged alternately in a circumferential direction, however, looked at in the direction of the nozzle axis line the air passages 10 are situated further to the back end side than the liquid reservoir 22, a point which differs to the embodiment shown in FIG. 1. Accordingly, because the liquid fuel LF is injected into the swirling flow Ac which is formed by the air which has flowed into the annular space 7 from the air passages 10, it is spread with more uniformity on the inner wall surface 5 of the outer cylinder 2 by the extending action of the swirling flow Ac. Furthermore, in the above-mentioned embodiments, examples are shown with the air passages 10 formed in the outer cylinder 2 which is the outer member, but clearly, forming them in the inner cylinder 3 which is the inner member is also acceptable.

In a liquid atomizing nozzle of this invention, with regard to the liquid and the gas which flow into the annular space respectively through the liquid passages formed in the outer member and the gas passages formed in at least one of the inner and outer members, because both passages are formed inclined to the radial direction, the liquid is injected into the annular space having a component swirling in the circumferential direction, and the gas generates a swirling flow in the same direction within the annular space. The liquid which is injected and flows within the annular space is spread on the inner wall of the outer member by the swirling flow of gas, so that even in cases where there are deviations in the liquid injected to within the annular space, the liquid film flows while spreading in the circumferential direction. Furthermore, in contrast to conventional air-blast type liquid atomizing nozzles, which for the most part spread a liquid film through the swirling movement given to the liquid by spiral channels, in a liquid atomizing nozzle of this invention, the thickness of the liquid film can be made more uniform in a circumferential direction, and the atomizing of the liquid at the front end edge of the outer member can be facilitated further. In other words, the uniformity of the liquid film thickness can be improved by utilizing the swirling of the gas, as a result, the generation of larger droplets are inhibited and a liquid mist uniform in the circumferential direction can be formed.

In particular, when a liquid is atomized and supplied to an engine as a liquid fuel, there is no development of deviations in the thickness of the fuel film in the circumferential direction around the axis line of the atomizing nozzle attributable to deviations in the discharge rate in the direction of the circumference, and the fuel film thickness is made uniform, and the droplets are made all the smaller and atomizing can be facilitated, so that deviations in the temperature distribution within the combustion chamber are curbed, and high temperature combustion or locally incomplete combustion is averted. As a result, problems of increased generation of harmful components or incompletely combusted components may be resolved, and abnormal combustion or the generation of harmful substances can be reduced. Moreover, in a liquid atomization nozzle of this invention, there is no necessity to reduce the discharge passage cross sections through which the liquid fuel flows, so that it can also be applied to heavy oils in which solid deposits develop easily through rises in temperature.

What is claimed is:

1. A liquid atomizing nozzle, which comprises an outer member, and an inner member which is arranged within said outer member and forms an annular space which is open towards a front end side with said outer member; and in which a liquid that has been injected into said annular space is atomized from the front end of said outer member, wherein said outer member is provided with liquid passages inclined to the radial direction and for injecting said liquid into said annular space, at least one of said outer member and said inner member is provided with gas passages that are opening to said annular space and are inclined to the radial direction in order to swirl a gas in the same direction as the flow direction of said liquid that has been injected into said annular space, and said gas passages are open in said annular space in a position further to the back end side than the liquid passages are open in said annular space, when viewed in the direction of the axis line of said liquid atomizing nozzle;

wherein said outer member is a tapered outer cylinder in which the front end is thin walled, and said inner member is an inner cylinder disposed on the same axis as said outer cylinder and connected at the back end side and through the inside of which flows an air stream which atomizes said liquid at the front end of said annular space.

2. The liquid atomizing nozzle as claimed in claim 1, wherein said gas passages are open in a condition tangential to the circumference of the inner wall surface of said outer member.

3. The liquid atomizing nozzle as claimed in claim 1, wherein said liquid passages are open in condition tangential to the circumference of the inner wall surface of said outer member.

4. The liquid atomizing nozzle as claimed in claim 1, wherein said liquid passages and said gas passages are open in said annular space alternately in the circumferential direction.

5. The liquid atomizing nozzle as claimed in claim 1, wherein swirlers are provided in at least one of the inner circumference of said inner cylinder or the outer circumference of said outer cylinder, for giving swirling movement to the air stream flowing along said inner circumference or said outer circumference.

6. A liquid atomizing nozzle, which comprises an outer member, and an inner member which is arranged within said outer member and forms an annular space which is open towards a front end side with said outer member; and in which a liquid that has been injected into said annular space is atomized from the front end of said outer member, wherein said outer member is provided with liquid passages inclined to the radial direction and for injecting said liquid into said annular space, and at least one of said outer member and said inner member is provided with gas passages that are opening to said annular space and are inclined to the radial direction in order to swirl a gas in the same direction as the flow direction of said liquid that has been injected into said annular space, and wherein said outer member is a tapered outer cylinder in which the front end is thin walled, and said inner member is an inner cylinder disposed on the same axis as said outer cylinder and connected at the back end side and through the inside of which flows an air stream which atomizes said liquid at the front end of said annular space.

7. The liquid atomizing nozzle as claimed in claim 6, wherein swirlers are provided in at least one of the inner circumference of said inner cylinder or the outer circumference of said outer cylinder, for giving swirling movement to the air stream flowing along said inner circumference or said outer circumference.

* * * * *